US009375044B2

(12) United States Patent
Domenico

(10) Patent No.: US 9,375,044 B2
(45) Date of Patent: Jun. 28, 2016

(54) ANTI-FOG VISOR WITH OPPOSED VENTS

(71) Applicant: SQUARE ONE PARACHUTES, INC., Murrieta, CA (US)

(72) Inventor: Anthony J. Domenico, Menifee, CA (US)

(73) Assignee: SQUARE ONE PARACHUTES, INC., Murrieta, CA (US)

( * ) Notice: Subject to any disclaimer, the term of this patent is extended or adjusted under 35 U.S.C. 154(b) by 739 days.

(21) Appl. No.: 13/734,249

(22) Filed: Jan. 4, 2013

(65) Prior Publication Data

US 2014/0189941 A1 Jul. 10, 2014

(51) Int. Cl.
*A42B 3/24* (2006.01)

(52) U.S. Cl.
CPC ..... *A42B 3/24* (2013.01)

(58) Field of Classification Search
CPC ..... A42B 3/0493; A42B 3/22; A42B 3/24; A42B 3/28; A42B 3/281; A42B 3/283; A42B 3/221; A42B 3/222
See application file for complete search history.

(56) References Cited

U.S. PATENT DOCUMENTS

| | | | | | |
|---|---|---|---|---|---|
| 3,748,658 | A * | 7/1973 | Albright | A42B 3/226 | 2/10 |
| 3,774,239 | A * | 11/1973 | Kotzar | A42B 3/227 | 2/10 |
| 4,195,328 | A | 3/1980 | Harris, Jr. | | |
| 4,760,373 | A | 7/1988 | Reilly | | |
| 4,769,629 | A | 9/1988 | Tigwell | | |
| 4,862,331 | A | 8/1989 | Hanabusa | | |
| 4,901,210 | A | 2/1990 | Hanabusa | | |
| 4,956,752 | A | 9/1990 | Foglietti | | |
| 5,040,099 | A | 8/1991 | Harris | | |
| 5,185,889 | A * | 2/1993 | Kamata | A42B 3/222 | 2/424 |
| 5,353,008 | A | 10/1994 | Eikenberry | | |
| 5,416,675 | A | 5/1995 | DeBeaux | | |
| 5,477,209 | A | 12/1995 | Benson | | |
| 5,704,707 | A | 1/1998 | Gebelein et al. | | |
| 5,910,764 | A | 6/1999 | Hayden | | |
| 2006/0059606 | A1 | 3/2006 | Ferrara | | |
| 2008/0141443 | A1 * | 6/2008 | Arai | A42B 3/222 | 2/424 |
| 2009/0183302 | A1 * | 7/2009 | Choi | A42B 3/222 | 2/424 |
| 2013/0152283 | A1 * | 6/2013 | Domenico | A42B 3/24 | 2/424 |
| 2013/0291292 | A1 * | 11/2013 | Reynolds | A42B 3/24 | 2/424 |
| 2014/0189941 | A1 * | 7/2014 | Domenico | A42B 3/24 | 2/424 |

FOREIGN PATENT DOCUMENTS

| | | | | |
|---|---|---|---|---|
| EP | 1216626 A1 * | 6/2002 | ..... | A42B 3/222 |
| WO | WO 2009020909 A2 * | 2/2009 | ..... | A42B 3/223 |

* cited by examiner

*Primary Examiner* — Shaun R Hurley
*Assistant Examiner* — Andrew W Sutton
(74) *Attorney, Agent, or Firm* — Nydegger & Associates

(57) ABSTRACT

A head-protector is described herein having a shell that is dimensioned to fit on the head of a user. The shell is formed with an opening to expose the face of the user. A locking mechanism attaches a lens to the shell and allows the lens to be pivoted between an operational position in which the lens covers the opening of the shell and a stowed position. Vents are established between an edge of the lens and the shell to establish an airflow over the inside surface of the lens to reduce fogging when the head-protector is subjected to an outside airflow such as wind. The vents can include a first vent that extends across the forehead of the user between the edge of the lens and the shell and a second vent that extends across the chin of the user between the edge of the lens and the shell.

17 Claims, 2 Drawing Sheets

ANTI-FOG VISOR WITH OPPOSED VENTS

FIELD OF THE INVENTION

The present invention pertains generally to head protectors (i.e. helmets) for use in sporting activities. More particularly, the present invention pertains to head protectors for use in sporting activities such as skydiving in which the user is exposed to an airstream. The present invention is particularly, but not exclusively, useful as a head protector for use in an airstream that is designed to reduce fogging of the head protector's lens and improve user visibility and comfort.

BACKGROUND OF THE INVENTION

Skydiving, sometimes called parachuting, is a sport in which participants exit an aircraft during flight, deploy a parachute to slow their descent, and thereafter land safely on the ground. Skydivers often wear helmets during these activities. The purpose of these helmets is two-fold. First, the helmet can be used to reduce the extent of a head injury should the skydiver make a hard landing or collide with another skydiver during flight. In addition, the helmet shields the skydiver's face and eyes from direct air flow during a jump.

During a jump, fog can accumulate on the lens of a skydiver's head protector, for example, due to moisture in the skydiver's breath. This fog can reduce visibility making navigation and landing difficult. During the time interval after the skydiver jumps from the aircraft and before the parachute opens, skydivers often engage in various activities in the relative wind that is established due to their velocity. This activity is sometimes referred to as 'free fall'. During free fall, skydivers often position themselves in various attitudes relative to the wind including the so-called "head-up" attitude and the so-called "head-down" attitude. As described herein, vents can be positioned near the head protector lens to reduce fogging by allowing outside air to flow directly over the inside surface of the lens. Preferably, this air flow will be a substantially laminar flow rather than a turbulent flow.

Turbulence or turbulent flow is a flow regime characterized by chaotic and irregular flow and often includes so-called flow eddies. These flow eddies can be described as a swirling of a fluid and the associated reverse flow currents that are created when a fluid flows over or past an obstacle. On the other hand, laminar flow, which is also called streamline flow, is a flow regime in which a fluid flows in substantially parallel layers with little or no disruption between the layers. During laminar flow, flow eddies and reverse currents do not occur to any significant extent when a fluid flows over or past an obstacle. Whether a particular flow is turbulent or laminar is determined primarily as a function of fluid flow velocity and the shape of the obstacle/surface interacting with the fluid flow.

Turbulent flow during skydiving can be problematic for several reasons. This is particularly so when the turbulence is created on the surface of a head protector lens. First, it can disrupt the user's visibility with the impact of the turbulence against the skydiver's face. In addition, turbulence can create noise and vibration which is distracting, and in some cases dangerous, to the skydiver.

With the above in mind, it is an object of the present invention to provide a head protector for use in an air flow that includes vents to reduce lens fogging. It is another object of the present invention to provide a head protector having fog reducing lens vents that are sized and positioned to reduce turbulent flow on the inside surface of the lens. It is still another object of the present invention to provide a head protector for use in skydiving that improves user visibility, comfort and safety as the skydiver engages in various activities such as positioning themselves in a head-up or head-down attitude. It is yet another object of the present invention to provide a head protector for use in skydiving that is easy to use, relatively simple to manufacture, and comparatively cost effective.

SUMMARY OF THE INVENTION

In accordance with the present invention, a head-protector is provided which includes a shell that is dimensioned to fit on the head of a user. For example, the head-protector can be used during skydiving or some other activity that requires head protection. For the head-protector, the shell is formed with an opening to expose the face of the user when the shell is positioned on the user's head. In addition, the head-protector includes a lens that is dimensioned to cover the opening of the shell. In more structural detail, the lens is formed with an edge and is made of a transparent material to allow the user to see through the lens.

A locking mechanism is provided to attach the lens to the shell. Functionally, the locking mechanism operates to support the lens on the shell and to allow the lens to be moved between an operational position and a stowed position. For example, the locking mechanism includes a left temple support device and a right temple support device. The left temple support device is affixed to the shell and engaged with the lens on one side of the opening. Similarly, the right temple support device is affixed to the shell and engaged with the lens at a position on the shell that is located across the opening from the left temple support device. With this arrangement, a pivot axis is established by the left and right temple support devices. This then allows the lens to be rotated about the pivot axis between the stowed and operational positions. With the lens in a stowed position, the lens is oriented on the shell to expose the face of the user. On the other hand, when the lens is in the operational position, the lens is oriented on the shell to cover the opening.

For the present invention, when the lens is in its operational position, vents are established between the edge of the lens and the shell. These vents allow outside air to flow over the inside surface of the lens to reduce, and in some cases eliminate, fogging. For the case where the head-protector is a sky diving helmet, the vents can be designed to ensure that airflow over the lens is laminar (i.e. non-turbulent) during skydiving activities. More specifically, the vents can reduce turbulent flow on the inside surface of the lens when the skydiver is either in a head-up attitude or a head-down attitude.

Typically, the vents include a first vent that extends across the forehead of the user between the edge of the lens and the shell, and a second vent that extends across the chin of the user between the edge of the lens and the shell. To establish these vents, the edge of the lens is spaced from the outer surface of the shell at a substantially constant distance "d" along the respective vent. In most cases, the first vent and the second vent are each established with a substantially same distance "d" along the respective vent. In more quantitative terms, the distance "d" is typically less than approximately two-tenths of an inch ($d<0.2$ inch).

For another embodiment of a head-protector in accordance with the present invention, the opening in the shell defines a periphery and the head-protector includes a band and a plurality of posts. For this embodiment, the band is dimensioned to surround the opening of the shell and to cause a snug fit with the shell along the periphery of the opening when the lens is in its operational position. Also, the band is engaged with the locking mechanism and moves with the lens during a rotation of the lens between the stowed and operational positions. With the band in place, the posts then interconnect the band with the lens at points adjacent to the edge of the lens. This then separates the band from the edge of the lens by the required distance "d" to establish the first and second vents.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
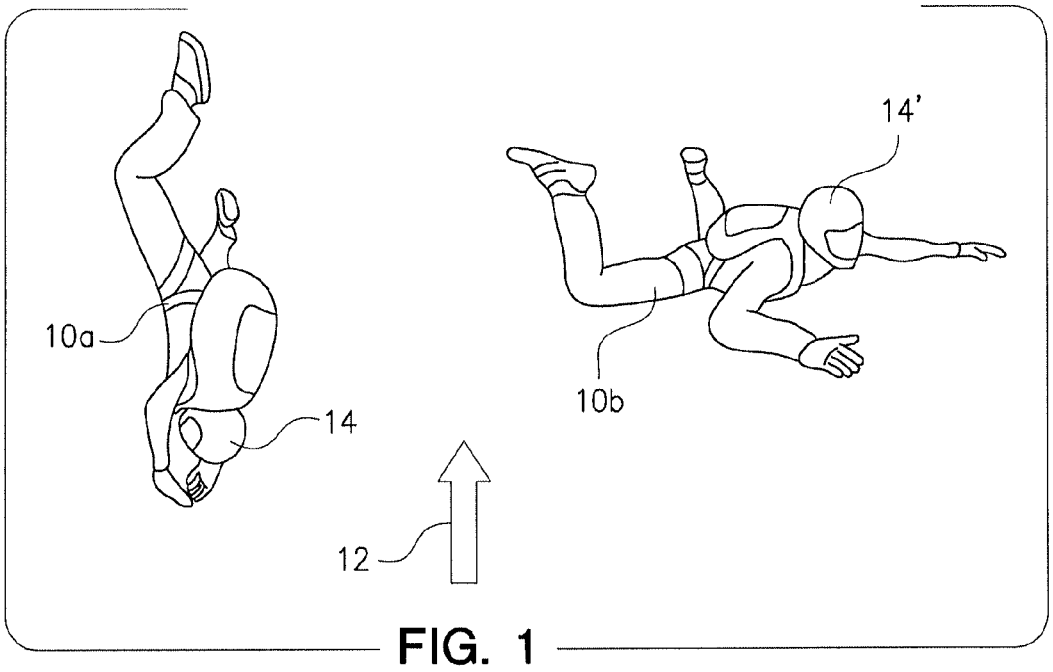
FIG. 1 is a depiction of two sky divers in free fall, with one in a head-down attitude and the other in a head-up attitude.

Referring initially to FIG. 1, a pair of sky divers 10*a*, 10*b* are shown in free fall moving in a direction opposite a relative wind (illustrated by arrow 12). As shown, sky diver 10*a* is positioned in a so-called "head-down" attitude and sky diver 10*b* is positioned in a so-called "head-up" attitude. Also, FIG. 1 shows that sky diver 10*a* is wearing a head protector 14 and sky diver 10*b* is wearing a head protector 14'.

Figure 2:
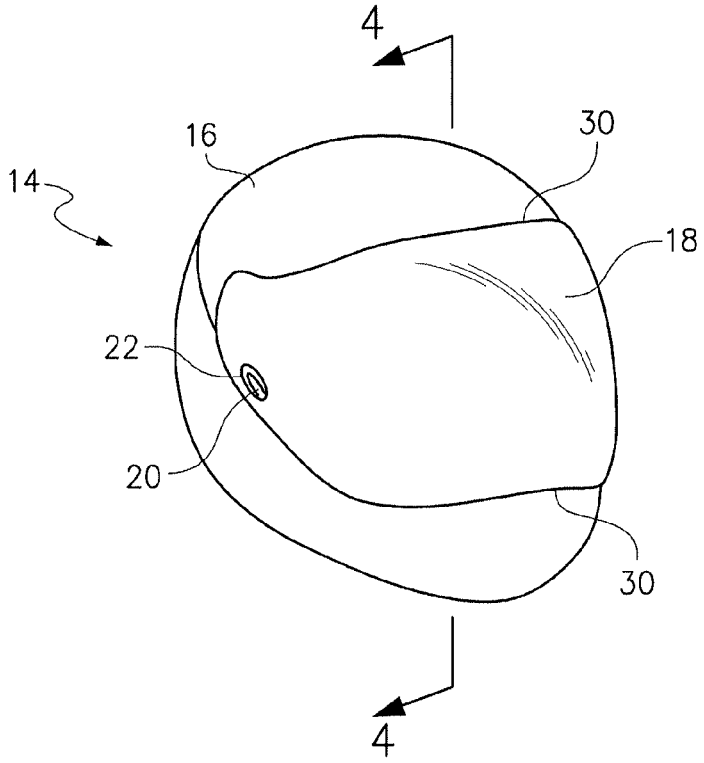
FIG. 2 is a perspective view of a head-protector in accordance with the present invention.
Figure 3A:
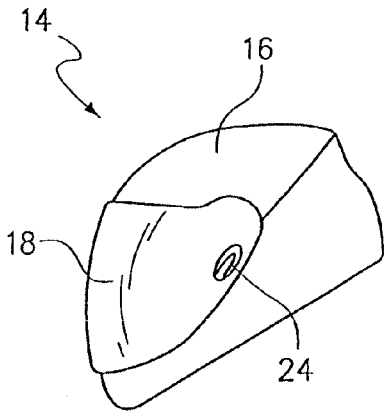
FIG. 3A is a side view of the head-protector of the present invention with its lens in an operational position for covering the face of the user.
Figure 3B:
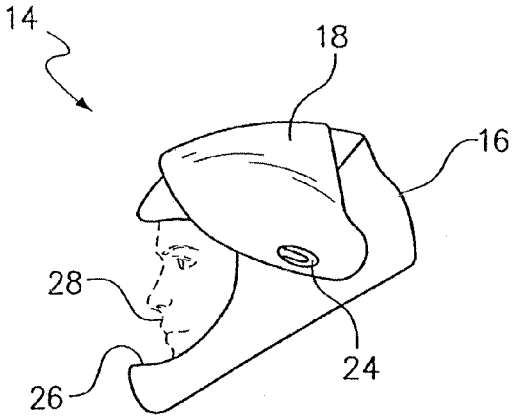
FIG. 3B is a side view of the head-protector of the present invention as seen in FIG. 3A with its lens in a stowed position to uncover the face of the user.

FIG. 2 shows a first embodiment of a head protector 14 in accordance with the present invention. As shown, the head-protector 14 includes a shell 16 and a lens 18 (sometimes referred to in the art as a visor). With cross-reference to FIGS. 2 and 3A, it can be seen that the head protector 14 includes a locking mechanism 20 having a right temple support device 22 and a left temple support device 24 for attaching the lens 18 to the shell 16. As best seen in FIG. 3B, the shell 16 is formed with an opening 26 to expose the user's face 28 when the head protector 14 is positioned on the head of the user. Comparing FIGS. 3A and 3B, it can be seen that the lens 18 is dimensioned to cover the opening 26 of the shell. FIG. 2 shows that the lens 18 is formed with an edge 30.

The functionally of the locking mechanism 20 can best be appreciated with cross reference to FIGS. 2 and 3B. Specifically, as shown, the locking mechanism 20 operates to support the lens 18 on the shell 16 and allow the lens 18 to be moved between an operational position (shown in FIGS. 2 and 3A) and a stowed position (shown in FIG. 3B). More specifically, the left temple support device 24 and right temple support device 22 establish a pivot axis that allows the lens 18 to be rotated about the pivot axis between the stowed and operational positions.

Figure 4A:
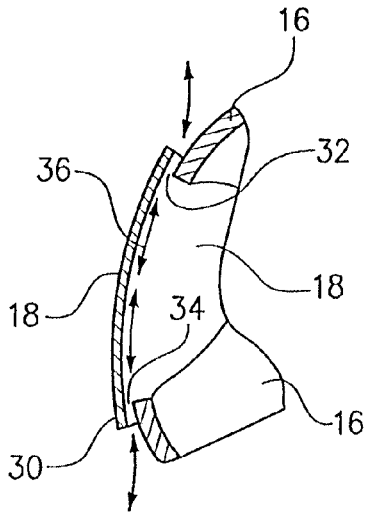
FIG. 4A is a partial cross section view of the head-protector as seen along the line 4-4 in FIG. 2 showing the interaction of the lens with the shell that establishes respective air vents across the forehead and across the chin of a user.

Referring now to FIG. 4A, it can be seen that the lens 18 cooperates with the shell 16 to establish vents 32, 34 between the edge 30 of the lens 18 and the shell 16. As shown, vent 32 extends across the forehead of the user between an upper portion of the lens edge 30 and the shell 16 and vent 34 extends across the chin of the user between a lower portion of the lens edge 30 and the shell 16. To create the vents 32, 34, the edge 30 of the lens 18 is spaced from outer surface of the shell 16 by a distance "d" along the respective vent 32, 34. Typically, the distance "d" is in the range of about one-tenth of an inch to about three tenths of an inch (0.1 inch<d<0.3 inch). With this arrangement, outside air flows in one vent 32, 34 and out the other vent 32, 34, depending on the direction of outside air flow, as illustrated by arrow 36. Between the vents 32, 34, air flows along the inside surface of the lens 18 to reduce, and in some cases eliminate, fogging of the lens 18. For example, when a skydiver is operationally in a head-up attitude, air will flow upward from vent 34 to vent 32, and when a skydiver is operationally in a head-down attitude air will flow downward from vent 32 to vent 34. For both cases, the position of the vents 32, 34 and the vent spacing "d" are designed to reduce turbulent flow along the inside surface of the lens 18.

Figure 4B:
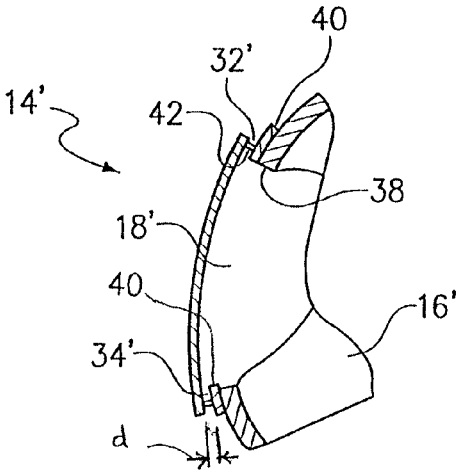
FIG. 4B is a partial cross section view of an alternate embodiment of the head-protector as would be seen along the line 4-4 in FIG. 2 showing the incorporation of a band for interaction of the lens with the shell that establishes respective air vents across the forehead and across the chin of a user.

FIG. 4B shows another embodiment of a head-protector 14' in accordance with the present invention. For this embodiment, the opening in the shell 16' defines a periphery 38 and the head-protector 14' includes a band 40 and a plurality of posts 42. As shown, the band 40 is dimensioned to surround the opening of the shell 16' and to cause a snug fit with the shell 16', along the periphery 38 of the opening, when the lens 18' is in its operational position. Also, for this embodiment, the band 40 is engaged with the locking mechanism (shown in FIG. 2) and moves with the lens 18' during a rotation of the lens between the stowed and operational positions. With the band 40 in place, the posts 42 interconnect the band 40 with the lens 18' at points adjacent to the edge of the lens 18'. With this arrangement, the posts 42 space the band 40 and the edge of the lens 18' by the distance "d" to establish the vents 32', 34'.

While the particular Anti-Fog Visor With Opposed Vents as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A head-protector which comprises:

a shell dimensioned to fit on the head of a user, wherein the shell is formed with an opening defining a periphery;

a lens dimensioned to cover the opening of the shell, wherein the lens has an edge and is made of a transparent material;

a locking mechanism for supporting the lens on the shell, wherein the locking mechanism is selectively activated to alternatively hold the lens in a stowed position wherein the lens is oriented on the shell to uncover the opening, and in an operational position wherein the lens is oriented over the opening and is configured to establish a first vent extending across the forehead of the user between the edge of the lens and the shell and is configured to establish a second vent extending across the chin of the user between the edge of the lens and the shell to provide for laminar flow of air over the lens between the first vent and the second vent;

a band dimensioned to surround the opening of the shell and to cause a snug fit with the shell, along the periphery of the opening, when the lens is in its operational position; and a plurality of posts interconnecting the band with the lens at points adjacent the edge of the lens to establish a distance "d" between the band and the edge of the lens to establish the first vent and the second vent, wherein the band is engaged with the locking mechanism for movement of the band with the lens during a rotation of the lens between the stowed position and the operational position.

2. A head-protector as recited in claim 1 wherein the locking mechanism comprises:

a left temple support device affixed to the shell and engaged with the lens; and a right temple support device affixed to the shell and engaged with the lens across the opening from the left temple support device to establish a pivot axis defined by the respective left and right temple support devices for rotating the lens between the stowed position and the operational position.

3. A head-protector as recited in claim 1 wherein the first vent and the second vent are each established with the substantially same distance "d" along the respective vent between the edge of the lens and an outer surface of the shell.

4. A head-protector as recited in claim 3 wherein the distance "d" is less than two-tenths of an inch (d<0.2 inch).

5. A head-protector as recited in claim 1 wherein the head-protector is a sky diving helmet, and laminar flow over the lens is provided between the first and second vents when the user is operationally in a head-up attitude and in a head-down attitude.

6. A skydiving head-protector which comprises:

a shell dimensioned to fit on the head of a user, wherein the shell is formed with an opening defining a periphery;

a lens dimensioned to cover the opening of the shell, wherein the lens has an edge and is made of a transparent material;

a means for supporting the lens on the shell and for spacing a first portion of the edge of the lens from the periphery of the shell to establish a first vent having a thickness of distance "d" and for spacing a second portion of the edge of the lens from the periphery of the shell to establish a second vent having a thickness of distance "d", with the distance "d" selected to establish a non-turbulent airflow from the first vent to the second vent during a skydiving activity;

a band dimensioned to surround the opening of the shell and to cause a snug fit with the shell, along the periphery of the opening, when the lens is in an operational position wherein the lens is oriented over the opening; and a plurality of posts interconnecting the band with the lens at points adjacent the edge of the lens to establish the distance "d" between the band and the edge of the lens to establish the first vent and the second vent.

7. A head-protector as recited in claim 6 wherein the means for supporting the lens comprises:

a left temple support device affixed to the shell and engaged with the lens; and a right temple support device affixed to the shell and engaged with the lens across the opening from the left temple support device to establish a pivot axis defined by the respective left and right temple support devices for rotating the lens between a stowed position and the operational position.

8. A head-protector as recited in claim 6 wherein the first vent is configured to extend across the forehead of the user and the second vent is configured to extend across the chin of the user.

9. A head-protector as recited in claim 6 wherein the distance "d" is in the range of one-tenth of an inch to three tenths of an inch (0.1 inch<"d"<0.3 inch).

10. A head-protector as recited in claim 7 wherein the means for supporting the lens on the shell is selectively activatable to alternatively hold the lens in the stowed position wherein the lens is oriented on the shell to uncover the opening and the operational position wherein the lens is oriented over the opening.

11. A head-protector as recited in claim 7 wherein the band is engaged with the supporting means for movement of the band with the lens during a rotation of the lens between the stowed position wherein the lens is oriented on the shell to uncover the opening and the operational position wherein the lens is oriented over the opening.

12. A head-protector which comprises:

a shell dimensioned to fit on the head of a user, wherein the shell is formed with an opening, the opening defining a periphery;

a lens dimensioned to cover the opening of the shell, wherein the lens has an edge and is made of a transparent material;

a band dimensioned to surround the opening of the shell along the periphery of the opening, when the lens is in its operational position covering the opening; and a plurality of posts spacing the band from the lens at points adjacent the edge of the lens to establish a distance "d" between the band and the edge of the lens to establish a first vent and a second vent and wherein the first vent and the second vent are across the opening from each other to provide for laminar flow of air over the lens between the first vent and the second vent.

13. A head-protector as recited in claim 12 further comprising a locking mechanism for supporting the lens on the shell, wherein the locking mechanism is selectively activated to alternatively hold the lens in a stowed position wherein the lens is oriented on the shell to uncover the opening, and in an operational position wherein the lens is oriented over the opening.

14. A head-protector as recited in claim 13 wherein the band is engaged with the locking mechanism for movement of the band with the lens during a rotation of the lens between the stowed position and the operational position.

15. A head-protector as recited in claim 13 wherein the locking mechanism comprises:

a left temple support device affixed to the shell and engaged with the lens; and a right temple support device affixed to the shell and engaged with the lens across the opening from the left temple support device to establish a pivot axis defined by the respective left and right temple support devices for rotating the lens between the stowed position and the operational position.

16. A head-protector as recited in claim 12 wherein the head-protector is a sky diving helmet, and laminar flow over the lens is provided between the first and second vents when the user is operationally in a head-up attitude and, alternatively, in a head-down attitude.

17. A head-protector as recited in claim 12 wherein the distance "d" is in the range of one-tenth of an inch to three tenths of an inch (0.1 inch<"d"<0.3 inch).

* * * * *